US008870348B2

(12) United States Patent
Munakata et al.

(10) Patent No.: US 8,870,348 B2
(45) Date of Patent: Oct. 28, 2014

(54) LIQUID EJECTING HEAD AND LIQUID EJECTING APPARATUS

(75) Inventors: Manabu Munakata, Matsumoto (JP); Noriaki Okazawa, Shiojiri (JP)

(73) Assignee: Seiko Epson Corporation (JP)

( * ) Notice: Subject to any disclaimer, the term of this patent is extended or adjusted under 35 U.S.C. 154(b) by 10 days.

(21) Appl. No.: 13/477,634

(22) Filed: May 22, 2012

(65) Prior Publication Data

US 2012/0299997 A1 Nov. 29, 2012

(30) Foreign Application Priority Data

May 25, 2011 (JP) ..... 2011-116641

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1632* (2013.01); *B41J 2/1623* (2013.01)
USPC ..... 347/48; 347/19

(58) Field of Classification Search
CPC ..... B41J 2/0453
USPC ..... 347/47, 68, 71
See application file for complete search history.

(56) References Cited

U.S. PATENT DOCUMENTS 4,610,741 A * 9/1986 Mase et al. ..... 156/89.15
5,512,793 A * 4/1996 Takeuchi et al. ..... 310/328
5,617,127 A * 4/1997 Takeuchi et al. ..... 347/71
5,809,626 A * 9/1998 Takeuchi et al. ..... 29/25.35
5,831,651 A * 11/1998 Usui et al. ..... 347/70
5,908,682 A * 6/1999 Nanataki et al. ..... 428/138
6,070,310 A * 6/2000 Ito et al. ..... 623/17.11
6,075,222 A * 6/2000 Hasegawa ..... 219/121.71
6,109,736 A * 8/2000 Miyata et al. ..... 347/68
6,361,155 B1 * 3/2002 Kanda et al. ..... 347/70
7,360,874 B2 * 4/2008 Watanabe et al. ..... 347/71
7,600,318 B2 * 10/2009 Kitahara et al. ..... 29/890.1
7,699,442 B2 * 4/2010 Lim et al. ..... 347/70
2002/0015068 A1 * 2/2002 Tsukada et al. ..... 347/19
2004/0017429 A1 * 1/2004 Liu et al. ..... 347/47
2005/0030351 A1 * 2/2005 Sugahara et al. ..... 347/71
2006/0132550 A1 * 6/2006 Sugahara ..... 347/71
2007/0144001 A1 * 6/2007 Ohashi ..... 29/890.1
2011/0292130 A1 * 12/2011 Hayashi ..... 347/54

FOREIGN PATENT DOCUMENTS

JP 10-286956 10/1998
JP 2009-166334 7/2009

* cited by examiner

*Primary Examiner* — Matthew Luu
*Assistant Examiner* — Patrick King
(74) *Attorney, Agent, or Firm* — Harness, Dickey & Pierce, P.L.C.

(57) ABSTRACT

A liquid ejecting head includes a flow path formation substrate on which individual flow paths communicating with nozzle openings for ejecting liquid are provided, a first member which is provided at one surface side of the flow path formation substrate and has pressure generation units for generating pressure change in liquid in the individual flow paths, and a second member which is provided at a surface side of the flow path formation substrate, which is opposite to the first member. Dummy flow paths are provided on the flow path formation substrate independently of the individual flow paths. Exposure portions which expose a part of wall surfaces of the flow path formation substrate which form the dummy flow paths, are provided at least one of the first member and the second member.

10 Claims, 7 Drawing Sheets

LIQUID EJECTING HEAD AND LIQUID EJECTING APPARATUS

BACKGROUND

1. Technical Field

The present invention relates to a liquid ejecting head and a liquid ejecting apparatus which eject liquid through nozzle openings, in particular, relates to an ink jet recording head and an ink jet recording apparatus which eject ink as liquid.

2. Related Art

As an ink jet recording head as an example of a liquid ejecting head, there is the following ink jet recording head, for example. That is, there is an ink jet recording head which includes an actuator unit on which piezoelectric elements and pressure generation chambers are provided, and a flow path unit having a nozzle plate provided with nozzle openings which communicate with the pressure generation chambers and through which ink droplets are discharged.

The actuator unit is configured by laminating a flow path formation substrate on which the pressure generation chambers are formed, a vibration plate which is provided at one surface side of the flow path formation substrate and on which piezoelectric elements are provided, and a pressure generation chamber bottom plate which is provided at the other surface side of the flow path formation substrate, which is opposite to the vibration plate, on one another (for example, see JP-A-2009-166334).

Each substrate of such actuator unit is formed by a calcined member of ceramics or the like. However, if flow paths and the like are formed on the flow path formation substrate, the vibration plate, and the pressure generation chamber bottom plate, they are individually calcined, and then the calcined members are bonded to one another, there arises the following problem. That is, a problem that positional deviation or deviation in pitch is generated due to fluctuation in contraction by the calcination arises.

Therefore, after the flow paths and the like have been formed on the flow path formation substrate, the vibration plate, and the pressure generation chamber bottom plate, they are calcined in a laminated state. With this, they are integrated with one another without using an adhesive therebetween.

However, in an ink jet recording head obtained in such a manner that after the individual flow paths such as the pressure generation chambers have been formed on the flow path formation substrate, a first member as the vibration plate and a second member as the pressure generation chamber bottom plate are bonded to the flow path formation substrate and they are calcined at the same time so as to be integrated with one another, there is the following problem. That is, in the ink jet recording head, there is a problem in that shapes and dimensions of the pressure generation chambers after the calcination cannot be measured and breakage such as delaminating the first member, the second member, and the like needs to be performed in order to measure the shapes and the dimensions thereof.

If the shapes and the dimensions of the pressure generation chambers which have been contracted by the calcination cannot be checked and measured, the pressure generation chambers of which dimensions are made uniform cannot be mounted on an ink jet recording apparatus. This results in fluctuation in ink discharge characteristics and there arises a problem in that print quality is lowered.

It is to be noted that the above problems arise not only in the ink jet recording head but also in a liquid ejecting head which ejects liquid other than ink.

SUMMARY

An advantage of some aspects of the invention is to provide a liquid ejecting head and a liquid ejecting apparatus which make it possible to easily measure a dimension of an individual flow path without breaking.

A liquid ejecting head according to an aspect of the invention includes a flow path formation substrate on which an individual flow path communicating with a nozzle opening for ejecting liquid is provided, a first member that is provided at one surface side of the flow path formation substrate and has a pressure generation unit which generates pressure change in liquid in the individual flow path, and a second member that is provided at the other surface side of the flow path formation substrate, which is opposite to the first member. The liquid ejecting head is a liquid ejecting head formed by a calcined member in which the flow path formation substrate, the first member and the second member are integrated with one another, a dummy flow path is provided on the flow path formation substrate independently of the individual flow path, and an exposure portion that exposes a part of wall surfaces of the flow path formation substrate, which form the dummy flow path, is provided on at least one of the first member and the second member.

According to the aspect of the invention, the dimension of the dummy flow path can be measured through the exposure portion without delaminating the first member and the second member even after the liquid ejecting head has been formed as the calcined member. Therefore, the dimension of the individual flow path can be grasped from the dimension of the dummy flow path.

It is preferable that the exposure portion expose two opposed surfaces among the wall surfaces of the flow path formation substrate, the wall surfaces forming the dummy flow path. With this, a dimension of the dummy flow path can be measured easily and accurately.

Further, it is preferable that the exposure portions be provided at least both ends in a second direction intersecting with a first direction which is a direction in which the dummy flow path and the individual flow path are arranged in parallel. With this, dimensions of the dummy flow path in the first direction and the second direction can be measured.

Further, it is preferable that the exposure portion be provided so as to be opposed to an opening of the second member side of the nozzle openings that communicate with the dummy flow path. With this, a shape and a dimension of the opening of the second member at the side of the individual flow path can be measured through the exposure portion.

Further, it is preferable that the individual flow path be provided so as to penetrate through the flow path formation substrate. With this, the dimension of the dummy flow path can be reliably measured through the exposure portion only by providing the exposure portion on either of the first member or the second member.

In addition, a liquid ejecting apparatus according to another aspect of the invention includes the liquid ejecting head according to the above aspect of the invention.

According to the aspect of the invention, the liquid ejecting head in which dimensions of the individual flow paths are made uniform is mounted on the liquid ejecting apparatus, thereby making liquid ejecting characteristics uniform.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention is described in detail based on embodiments.

First Embodiment

Figure 1:
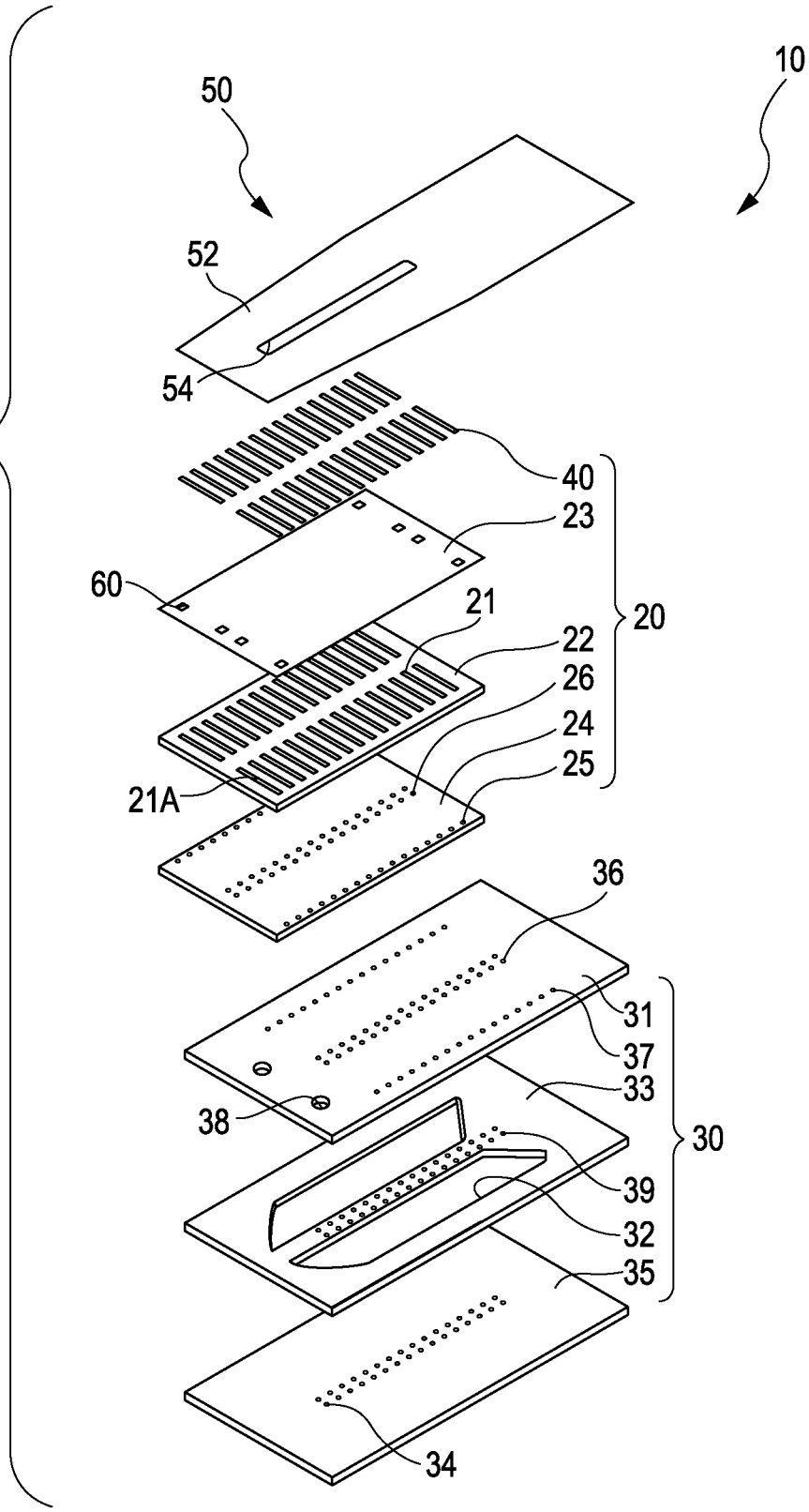
FIG. 1 is an exploded perspective view illustrating a recording head according to a first embodiment.
Figure 2:
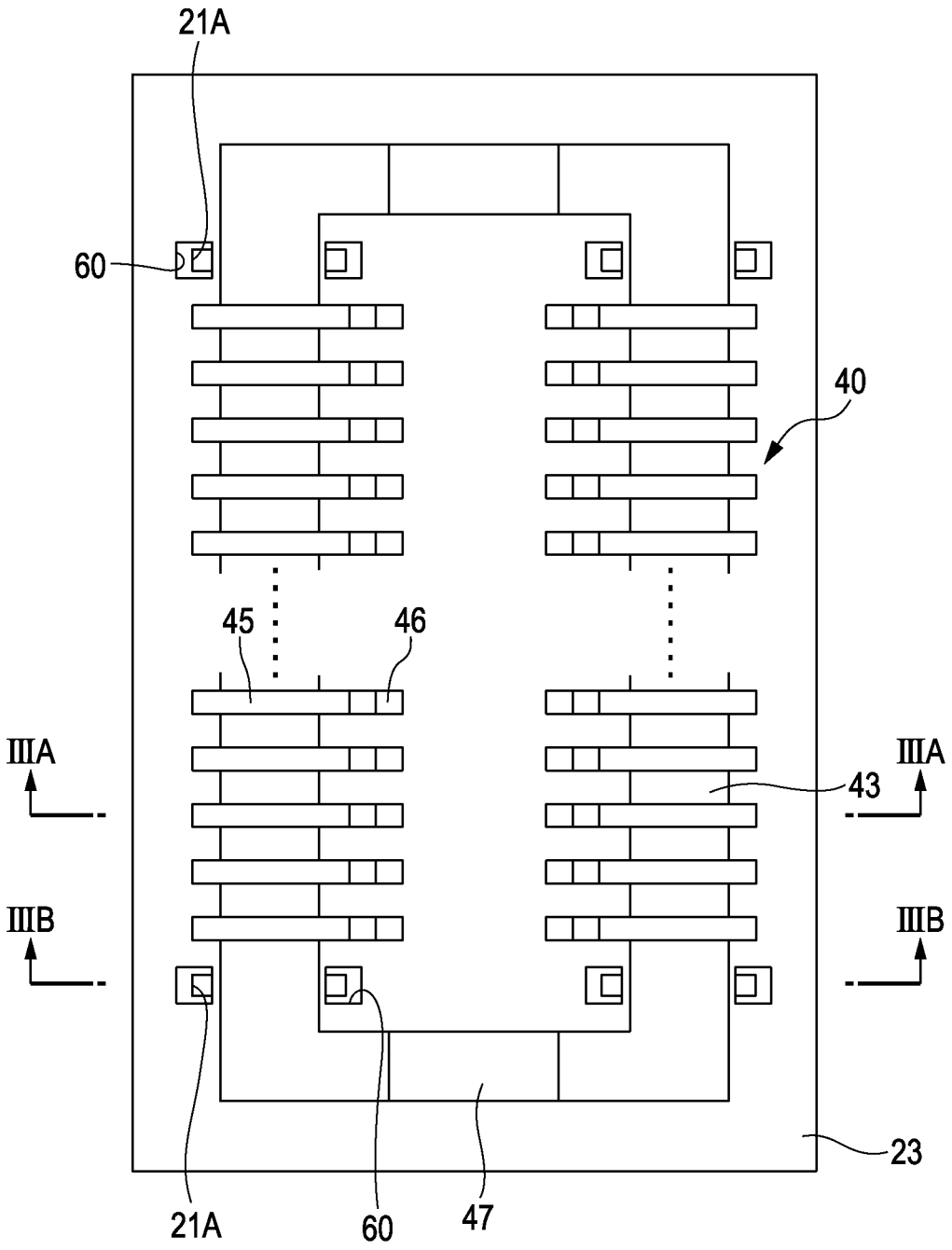
FIG. 2 is a top view illustrating an actuator unit according to the first embodiment.
Figure 3A:
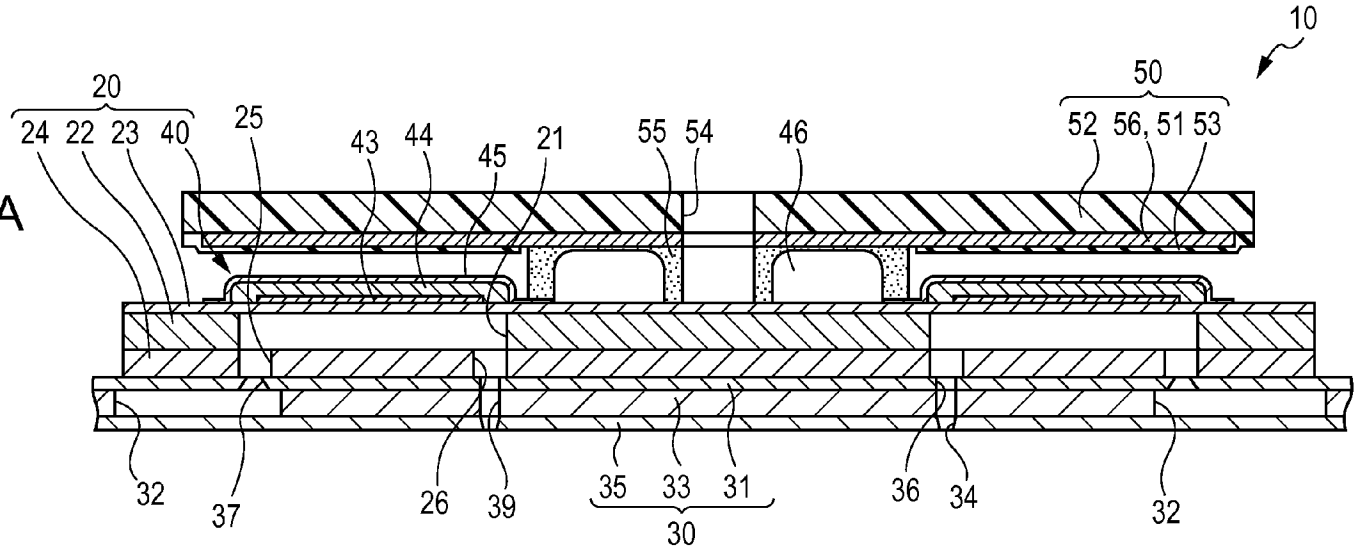
FIGS. 3A and 3B are cross-sectional views illustrating the recording head according to the first embodiment.
Figure 3B:
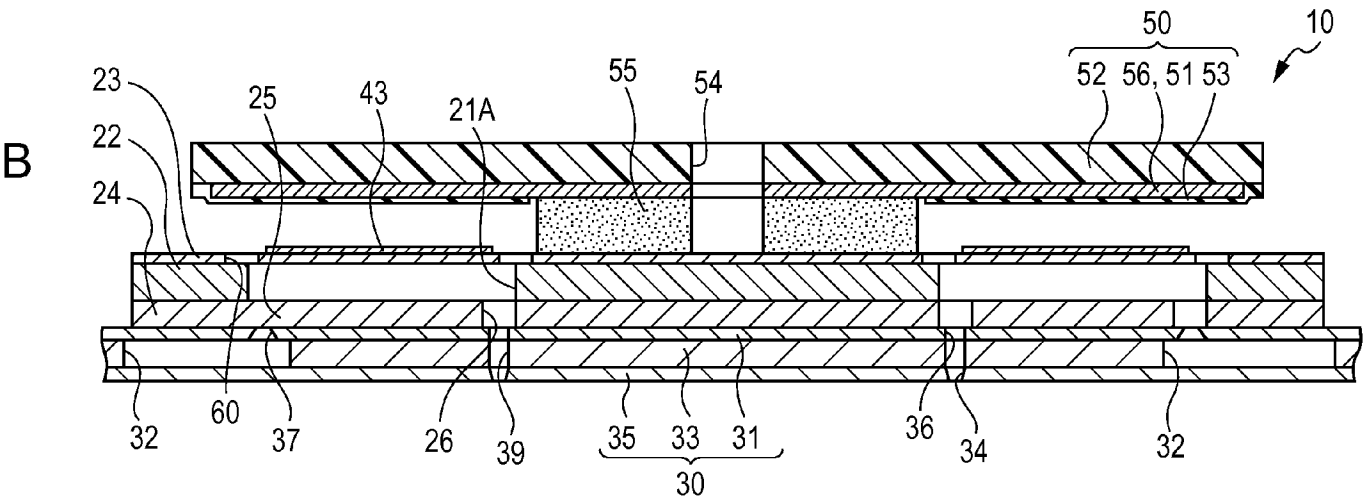

FIG. 1 is an exploded perspective view illustrating an ink jet recording head as an example of a liquid ejecting head according to the first embodiment of the invention. FIG. 2 is a plan view illustrating an actuator unit of the ink jet recording head. FIGS. 3A and 3B are a cross-sectional view cut along a line IIIA-IIIA of FIG. 2 and a cross-sectional view cut along a line IIIB-IIIB of FIG. 2.

As illustrated in the drawings, an ink jet recording head 10 according to the embodiment includes an actuator unit 20, one flow path unit 30 to which the actuator unit 20 is fixed, and a wiring substrate 50 which is connected to the actuator unit 20.

The actuator unit 20 is an actuator device including piezoelectric actuators 40 as a pressure generation unit. The actuator unit 20 includes a flow path formation substrate 22, a vibration plate 23, and a pressure generation chamber bottom plate 24. Pressure generation chambers 21 are formed on the flow path formation substrate 22. The vibration plate 23 is provided at one surface side of the flow path formation substrate 22. The pressure generation chamber bottom plate 24 is provided at the other surface side of the flow path formation substrate 22.

The flow path formation substrate 22 is formed by a calcined member obtained by calcination. In the embodiment, the flow path formation substrate 22 is formed by a ceramic plate of alumina ($Al_2O_3$), zirconia ($ZrO_2$), or the like, having a thickness of substantially 150 μm, for example.

Further, the pressure generation chambers 21 as individual flow paths are arranged in parallel on the flow path formation substrate 22. To be more specific, the pressure generation chambers 21 are arranged along a direction in which a plurality of nozzle openings 34 for discharging ink of the same color are arranged in parallel. Hereinafter, the direction is referred to as a parallel arrangement direction of the pressure generation chambers 21 or a first direction. Further, a plurality of rows of the pressure generation chambers 21 are provided on the flow path formation substrate 22. In the embodiment, two rows of the pressure generation chambers 21 are provided on the flow path formation substrate 22. The plurality of pressure generation chambers 21 are arranged in parallel in the first direction on each row. Hereinafter, a row arrangement direction in which the plurality of rows of the pressure generation chambers 21 formed along the first direction are arranged is referred to as a second direction. It is to be noted that in the embodiment, the pressure generation chambers 21 are provided so as to penetrate through the flow path formation substrate 22 in the thickness direction (direction in which the vibration plate 23, the flow path formation substrate 22, and the pressure generation chamber bottom plate 24 are laminated).

Further, dummy flow paths 21A are formed on the flow path formation substrate 22 at both ends of each row of the pressure generation chambers 21 which are arranged in parallel in the first direction. The dummy flow paths 21A are provided independently of the pressure generation chambers 21. The dummy flow paths 21A are formed at an interval (pitch) which is the same as an interval at which the plurality of pressure generation chambers 21 are arranged in parallel in the first direction. In addition, the dummy flow paths 21A are formed to have the same shapes as those of the pressure generation chambers 21. Note that the dummy flow paths 21A being provided independently of the pressure generation chambers 21 indicates that the dummy flow paths 21A do not communicate with the pressure generation chambers 21. That is to say, if the dummy flow paths 21A are made to communicate with manifolds 32 which are commonly connected to the plurality of pressure generation chambers 21, which will be described later, the dummy flow paths 21A communicate with the pressure generation chambers 21 through the manifolds 32. Therefore, in the embodiment, the dummy flow paths 21A are not made to communicate with the manifolds 32 so that the dummy flow paths 21A are made into an independent state where the dummy flow paths 21A do not communicate with the pressure generation chambers 21. As will be described in detail later, in the embodiment, the dummy flow paths 21A are not made to communicate with the manifolds 32 in the following manner. That is to say, supply communicating holes 25 communicating with the manifolds 32 are not provided on the pressure generation chamber bottom plate 24 at positions opposed to the dummy flow paths 21A so that the dummy flow paths 21A are not made to communicate with manifolds 32.

The vibration plate 23 formed by a calcined member obtained by calcination is provided as a first member on one surface of the flow path formation substrate 22. In the embodiment, the vibration plate 23 is formed by a ceramic plate of alumina ($Al_2O_3$), zirconia ($ZrO_2$), or the like, having a thickness of substantially 10 μm, for example. One surface sides of the pressure generation chambers 21 are sealed by the vibration plate 23.

Exposure portions 60 are provided on the vibration plate 23 at positions opposed to both ends of the dummy flow paths 21A in the second direction. The exposure portions 60 penetrate through the vibration plate 23 in the thickness direction. That is to say, two exposure portions 60 are provided for one dummy flow path 21A.

The exposure portions 60 expose a part of wall surfaces of the flow path formation substrate 22, which form the dummy flow paths 21A.

In the embodiment, each exposure portion 60 exposes three surfaces of each dummy flow path 21A in total including two wall surfaces opposed to each other in the first direction and one wall surface in the second direction. The exposure portions 60 are provided on both ends of each dummy flow path 21A in the second direction. With this, a width of each dummy flow path 21A in the first direction can be measured with one exposure portion 60 and a length of each dummy flow path 21A in the second direction can be measured with two exposure portions 60.

Note that in the embodiment, the exposure portions 60 have a rectangular opening shape. The opening shape of the exposure portions 60 is not particularly limited as long as the exposure portions 60 can expose the wall surfaces of the flow path formation substrate 22, which form the dummy flow paths 21A. The opening shape of the exposure portions 60 may be a circular shape, elliptical shape, triangular shape, or polygonal shape such as a pentagonal shape.

Further, the dummy flow paths 21A exposed through the exposure portions 60 may be covered by other members as long as the dummy flow paths 21A are not covered by the vibration plate 23 and the pressure generation chamber bottom plate 24. That is to say, as will be described in detail later, as long as the exposure portions 60 expose a part of the wall surfaces of the flow path formation substrate 22, which form the dummy flow paths 21A, in a state where the flow path formation substrate 22, the vibration plate 23, and the pressure generation chamber bottom plate 24 are laminated on one another and calcined, the exposure portions 60 may be covered by other members thereafter when other members such as the piezoelectric actuators 40 and wirings (individual terminal portions 46 and common terminal portions 47) are formed.

Thus, if the exposure portions 60 are provided so as to expose a part of the wall surfaces of the flow path formation substrate 22, which form the dummy flow paths 21A, after the flow path formation substrate 22, the vibration plate 23, and the pressure generation chamber bottom plate 24 have been laminated on one another and calcined, dimensions of the dummy flow paths 21A can be measured in an unbroken manner without delaminating the vibration plate 23 and the like. In particular, in the embodiment, the exposure portions 60 are provided on both ends of the dummy flow paths 21A in the second direction such that each exposure portion 60 exposes two wall surfaces of each dummy flow path 21A, which are opposed to each other in the first direction, and one wall surface thereof in the second direction. With this, dimensions of each dummy flow path 21A in both of the first direction and the second direction can be measured with two exposure portions 60 easily and accurately. That is to say, when the exposure portions 60 expose a part of the wall surfaces of the flow path formation substrate 22, which form the dummy flow paths 21A, it is preferable that the wall surfaces of the flow path formation substrate 22, which form the dummy flow paths 21A and are to be exposed, be two wall surfaces opposed to each other.

Moreover, in the embodiment, the dummy flow paths 21A are provided at both sides of each row of the pressure generation chambers 21 in the first direction, which are arranged in parallel in the first direction. Further, the exposure portions 60 are provided for both of two dummy flow paths 21A which are provided on each row. Therefore, dimensions of two dummy flow paths 21A which are provided on each row can be measured. Accordingly, fluctuation (trend) in dimensions of the pressure generation chambers 21 which are arranged in parallel in the first direction can be grasped. This makes it possible to grasp fluctuation in discharge characteristics of ink droplets to be discharged through the nozzle openings which are arranged in parallel in the first direction. Further, in the embodiment, two rows of the pressure generation chamber 21 which are arranged in parallel in the first direction are provided on the flow path formation substrate 22 in the second direction and the dummy flow paths 21A are provided on each row. Therefore, fluctuation in the dimensions of the pressure generation chambers 21 between the rows can be grasped.

The pressure generation chamber bottom plate 24 formed by a calcined member obtained by calcination is provided as a second member at the other surface side of the flow path formation substrate 22, which is opposite to the vibration plate 23. In the embodiment, the pressure generation chamber bottom plate 24 is formed by a ceramic plate of alumina ($Al_2O_3$), zirconia ($ZrO_2$), or the like.

The pressure generation chamber bottom plate 24 is fixed to the other surface side of the flow path formation substrate 22 so as to seal the other surfaces of the pressure generation chambers 21. Further, the pressure generation chamber bottom plate 24 includes supply communicating holes 25 and nozzle communicating holes 26. The supply communicating holes 25 are provided in the vicinity of one ends of the pressure generation chambers 21 in the lengthwise direction and communicate the pressure generation chambers 21 and the manifolds 32, which will be described later. The nozzle communicating holes 26 are provided in the vicinity of the other ends of the pressure generation chambers 21 in the lengthwise direction and communicate with the nozzle openings 34, which will be described later.

The supply communicating holes 25 and the nozzle communicating holes 26 are arranged so as to be located at the inner side with respect to both ends of the pressure generation chambers 21 in the second direction so as to prevent the following risk from arising. That is, when the flow path formation substrate 22 and the pressure generation chamber bottom plate 24 are bonded to each other, a risk that a part of the supply communicating holes 25 and the nozzle communicating holes 26 are located at the outer side with respect to the pressure generation chambers 21 due to tolerance, positional deviation, or the like, and walls of the pressure generation chambers 21 are overlapped in the supply communicating hole 25 and the nozzle communicating hole 26 is prevented from arising.

It is to be noted that only the nozzle communicating holes 26 are formed on the pressure generation chamber bottom plate 24 at positions opposed to the dummy flow paths 21A so as not to make the dummy flow paths 21A communicate with the manifolds 32 as described above. It is needless to say that a configuration in which the supply communicating holes 25 are provided on the pressure generation chamber bottom plate 24 at positions opposed to the dummy flow paths 21A and ink supply ports 37 which communicate with the supply communicating holes 25 and the manifolds 32 are not provided may be employed.

Further, the piezoelectric actuators 40 are provided on the vibration plate 23 on regions opposed to the pressure generation chambers 21. In the embodiment, two rows of the piezoelectric actuators 40 are also provided since two rows of the pressure generation chambers 21 arranged in parallel in the first direction are provided in the second direction.

Each piezoelectric actuator 40 is constituted by a lower electrode film 43, a piezoelectric layer 44, and an upper electrode film 45. The lower electrode film 43 is provided on the vibration plate 23. The piezoelectric layer 44 is provided independently for each pressure generation chamber 21. The upper electrode film 45 is provided on each piezoelectric layer 44. Each piezoelectric layer 44 is formed by bonding or printing a green sheet formed by a piezoelectric material. Further, each lower electrode film 43 is provided across the piezoelectric layers 44 which are arranged in parallel and is a common electrode to the plurality of piezoelectric actuators 40 and functions as a part of vibration plate. It is needless to say that the lower electrode film 43 may be provided for each piezoelectric layer 44. In addition, each upper electrode film 45 is provided independently for each piezoelectric layer 44 and is an individual electrode of each piezoelectric actuator 40. In the embodiment, the lower electrode films 43 are formed as common electrodes to the plurality of piezoelectric actuators 40 and the upper electrode films 45 are formed as individual electrodes of the piezoelectric actuators 40. However, there is no problem if their configurations are made inverse considering the conditions of a driving circuit or a wiring.

Figure 4A:
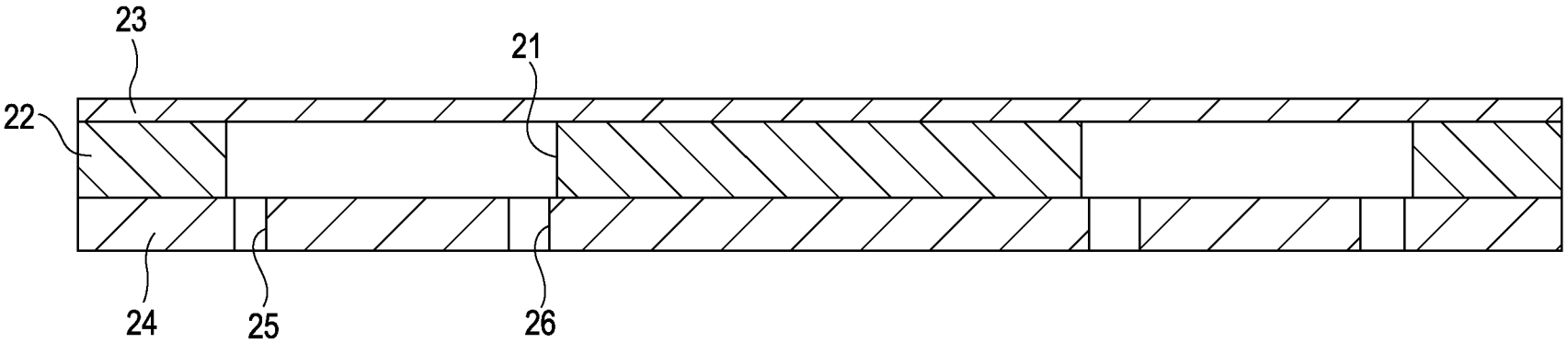
FIGS. 4A and 4B are cross-sectional views illustrating a method of manufacturing the recording head according to the first embodiment.
Figure 4B:
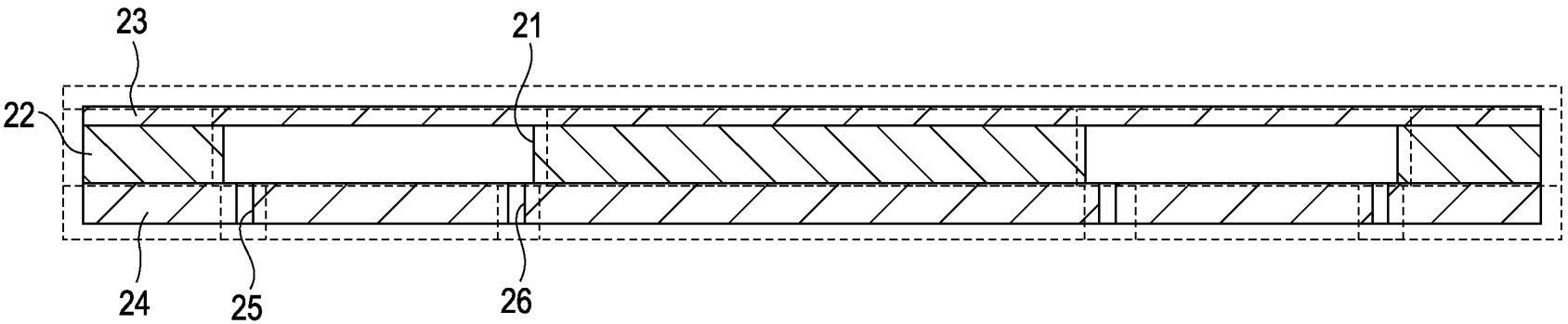

The layers constituting such actuator unit 20 are integrated with one another with the following manufacturing method. FIGS. 4A and 4B are cross-sectional views illustrating a method of manufacturing an ink jet recording head according to the first embodiment of the invention.

At first, as illustrated in FIG. 4A, the flow path formation substrate 22, the vibration plate 23, and the pressure generation chamber bottom plate 24 are formed by shaping a clay ceramic material, that is, a so-called green sheet into predetermined thicknesses. Then, the pressure generation chambers 21 and the like are provided thereon in a punching manner, for example, and then, they are laminated on one another.

Next, as illustrated in FIG. 4B, the flow path formation substrate 22, the vibration plate 23, and the pressure generation chamber bottom plate 24 which have been laminated on one another are calcined. With this, the layers constituting the actuator unit 20, that is, the flow path formation substrate 22, the vibration plate 23, and the pressure generation chamber bottom plate 24 are integrated with one another without using an adhesive. At this time, the flow path formation substrate 22, the vibration plate 23, and the pressure generation chamber bottom plate 24 are contracted by the calcination.

Further, the wall surfaces of the flow path formation substrate 22, which form the pressure generation chambers 21, are covered by the vibration plate 23 and the pressure generation chamber bottom plate 24. Therefore, dimensions of the pressure generation chambers 21 after being contracted in the first direction and the second direction cannot be checked. It is to be noted that the contraction degrees of the flow path formation substrate 22, the vibration plate 23, and the pressure generation chamber bottom plate 24 change depending on a calcination temperature, a calcination time, an environmental temperature, humidity, and the like. Furthermore, a plurality of laminated members of the layers constituting the actuator unit are formed by calcinating them at the same time. Therefore, temperature unevenness is generated depending on the laminated members arrangement in a heating device, resulting in fluctuation in contraction amounts. Accordingly, the dimensions of the pressure generation chambers 21 need to be directly measured. However, in order to directly measure the dimensions of the pressure generation chambers 21, breakage such as delaminating the vibration plate 23 and the pressure generation chamber bottom plate 24 is required. Therefore, the ink jet recording head cannot be used.

In the embodiment, the dummy flow paths 21A having the same shapes as the pressure generation chambers 21 are provided on the flow path formation substrate 22. In addition, two exposure portions 60 are provided on the vibration plate 23 for one dummy flow path 21A. The two exposure portions 60 expose two wall surfaces of one dummy flow path 21A, which are opposed to each other in the first direction, and two wall surfaces thereof, which are opposed to each other in the second direction. Therefore, even after the flow path formation substrate 22, the vibration plate 23, and the pressure generation chamber bottom plate 24 have been calcined and integrated with one another, the wall surfaces on both sides of the dummy flow paths 21A in both the first direction and the second direction are exposed to the outside. Accordingly, the dimensions of the dummy flow paths 21A exposed through the exposure portions 60 in the first direction and the second direction can be measured without breakage such as delaminating the vibration plate 23 and the pressure generation chamber bottom plate 24. Further, the dummy flow paths 21A of which dimensions have been measured in this manner are formed at a pitch which is the same as a pitch at which the plurality of pressure generation chambers 21 are arranged in parallel in the first direction. In addition, the dummy flow paths 21A are formed to have the same shapes as those of the pressure generation chambers 21. Therefore, the dimensions of the pressure generation chambers 21 after calcination can be measured by measuring the dimensions of the dummy flow paths 21A after calcination.

Further, in the embodiment, the dummy flow paths 21A are provided at the outer side with respect to both ends of each row of the pressure generation chambers 21 in the first direction, which are arranged in parallel in the first direction. In addition, the exposure portions 60 are provided for both of two dummy flow paths 21A provided on each row. Therefore, the dimensions of two dummy flow paths 21A provided on each row can be measured. A trend of fluctuation in the dimensions of the pressure generation chambers 21 which are arranged in parallel in the first direction can be grasped by measuring the dimensions of the dummy flow paths 21A provided at both sides of the rows of the pressure generation chambers 21 in the first direction. This makes it possible to grasp fluctuation in discharge characteristics of ink droplets discharged through the nozzle openings which are arranged in parallel in the first direction. Further, in the embodiment, two rows of the pressure generation chambers 21 which are arranged in parallel in the first direction are provided on the flow path formation substrate 22 in the second direction and the dummy flow paths 21A are provided on each row. Therefore, fluctuation in the dimensions of the pressure generation chambers 21 between the rows of the pressure generation chambers 21, which are arranged in parallel in the second direction, can be grasped. This makes it possible to grasp fluctuation in discharge characteristics of ink droplets for each row of the pressure generation chambers 21.

If the dimensions of the pressure generation chambers 21 are grasped in this manner, when a plurality of ink jet recording heads are mounted on an ink jet recording apparatus, the plurality of ink jet recording heads including the pressure generation chambers 21 having the same or similar dimensions can be mounted on the ink jet recording apparatus. Note that the dimensions of the pressure generation chambers 21 being made uniform indicates that ink discharge characteristics are made uniform. Therefore, if the ink jet recording heads having uniform discharge characteristics are mounted on the ink jet recording apparatus, print quality can be improved. It is to be noted that the ink jet recording heads may be ranked based on the dimensions of the pressure generation chambers 21 and combined for each rank.

After the flow path formation substrate 22, the vibration plate 23, and the pressure generation chamber bottom plate 24 have been calcined at the same time and integrated with one another as described above, the piezoelectric actuators 40 are formed on the vibration plate 23.

On the other hand, as illustrated in FIG. 1 and FIGS. 3A, 3B, the flow path unit 30 is constituted by an ink supply port formation substrate 31, a manifold formation substrate 33, and a nozzle plate 35. The ink supply port formation substrate 31 is bonded to the pressure generation chamber bottom plate 24 of the actuator unit 20. The manifolds 32 as common chambers to the plurality of pressure generation chambers 21 are formed on the manifold formation substrate 33. The nozzle openings 34 are formed on the nozzle plate 35.

The ink supply port formation substrate 31 is formed by a thin plate of zirconia having a thickness of 150 μm. The ink supply port formation substrate 31 is constituted by providing nozzle communicating holes 36 and ink supply ports 37 in a punching manner. The nozzle communicating holes 36 connect the nozzle openings 34 and the pressure generation chambers 21. The ink supply ports 37 connect the manifolds 32 and the pressure generation chambers 21 together with the above-mentioned supply communicating holes 25. Further, ink inlet ports 38 are provided on the ink supply port formation substrate 31. Each ink inlet port 38 communicates with each manifold 32 and supplies ink from an external ink tank.

The manifold formation substrate 33 includes the manifolds 32 and nozzle communicating holes 39 on a plate member which is suitable to constitute an ink flow path and has corrosion resistance, such as a stainless steel of 150 μm, for example. The manifolds 32 are supplied with ink from the external ink tank (not illustrated) and supply the ink to the pressure generation chambers 21. The nozzle communicating holes 39 communicate the pressure generation chambers 21 and the nozzle openings 34.

The nozzle plate 35 is formed by providing the nozzle openings 34 on a thin plate of a stainless steel, for example, in a punching manner. The nozzle openings 34 are provided at an arrangement pitch which is the same as a pitch at which the pressure generation chambers 21 are arranged. For example, in the embodiment, two rows of the nozzle openings 34 are also formed on the nozzle plate 35 since two rows of the pressure generation chambers 21 are provided on the flow path unit 30. Further, the nozzle plate 35 is bonded to a surface of the manifold formation substrate 33, which is opposite to the flow path formation substrate 22, so as to seal one surface sides of the manifolds 32.

Such flow path unit 30 is formed by fixing the ink supply port formation substrate 31, the manifold formation substrate 33, and the nozzle plate 35 with an adhesive, a thermal welding film, or the like. It is to be noted that in the embodiment, the manifold formation substrate 33 and the nozzle plate 35 are formed by a stainless steel. However, they can be formed by using ceramics, for example, and the flow path unit 30 can be integrally formed in the same manner as the actuator unit 20.

Further, the flow path unit 30 and the actuator unit 20 are bonded to and fixed to each other with an adhesive, a thermal welding film, or the like.

Further, as illustrated in FIG. 2, individual terminal portions 46 and common terminal portions 47 are provided as terminal portions conducting to the piezoelectric actuators 40 at one ends of the piezoelectric actuators 40 in the second direction. To be more specific, the individual terminal portions 46 and the common terminal portions 47 are provided on regions which are opposed to circumferential walls of the pressure generation chambers 21. Each individual terminal portion 46 is provided for each piezoelectric actuator 40 and is conducted to each upper electrode film 45 of each piezoelectric actuator 40. Further, the common terminal portions 47 are drawn to the both end sides in the direction in which the piezoelectric actuators 40 are arranged in parallel and are conducted to the lower electrode films 43. In the embodiment, two rows of the individual terminal portions 46 which are arranged in parallel are provided between the rows of the piezoelectric actuators 40 which are arranged in parallel. The common terminal portions 47 are provided at both sides in the direction in which the individual terminal portions 46 are arranged in parallel. Further, the common terminal portions 47 are provided commonly to the lower electrode films 43 of the two rows of the piezoelectric actuators 40. That is to say, the lower electrode films 43 of the two rows of the piezoelectric actuators 40 are continuous to each other at both ends sides in the direction (first direction) in which the piezoelectric actuators 40 are arranged in parallel. The common terminal portions 47 are provided on the continuous regions.

It is to be noted that the individual terminal portions 46 and the common terminal portions 47 can be formed by screen printing, for example, by using a metal material having high conductivity such as silver (Ag), for example.

Further, wiring layers 51 provided on the wiring substrate 50 are electrically connected to the individual terminal portions 46 and the common terminal portions 47, respectively, which are conducted to the upper electrode films 45 and the lower electrode films 43 of the piezoelectric actuators 40. A driving signal is supplied to each piezoelectric actuator 40 from a driving circuit (not illustrated) through the wiring substrate 50. It is to be noted that although not particularly illustrated in the drawings, the driving circuit may be mounted on the wiring substrate 50 or on another member other than the wiring substrate 50.

The wiring substrate 50 is formed by a flexible printing circuit (FPC), a tape carrier package (TCP), or the like, for example, which is provided for two rows of the piezoelectric actuators 40. To be more specific, the wiring substrate 50 is formed as follows. That is, the wiring layers 51 each having a predetermined pattern, which are obtained by subjecting a surface of a base film 52 formed with polyimide or the like to tin plating or the like while copper foil is used as a base, for example, are formed. Then, regions of the wiring layers 51 other than connection terminal portions which are connected to the individual terminal portions 46 and the common terminal portion 47 are covered by an insulating material 53 such as a resist.

Further, a through-hole 54 is provided on the wiring substrate 50 on a region opposed to a portion between the rows of the piezoelectric actuators 40, which are arranged in parallel. The wiring layers 51 are connected to the individual terminal portions 46 at ends at the side of the through-hole 54. It is to be noted that the through-hole 54 of the wiring substrate 50 is formed as follows. That is, the wiring layer 51 connected to the piezoelectric actuators 40 on one row and the wiring layer 51 connected to the piezoelectric actuators 40 on the other row are formed on the surface of the base film 52 on which the through-hole 54 is not provided so as to be continuous to each other. Thereafter, the conducted wiring layers 51 connected to the two rows of the piezoelectric actuators 40 are cut so as to form the through-hole 54.

Then, the wiring layers 51 of the wiring substrate 50, the individual terminal portions 46 and the common terminal portions 47 conducted to the piezoelectric actuators 40 are electrically connected to each other. Note that the wiring layers 51, the individual terminal portions 46 and the common terminal portions 47 can be connected to each other by using an anisotropic conductive material such as an anisotropic conductive film (ACF) and an anisotropic conductive paste (ACP), for example. As the anisotropic conductive material, a material that has been well known in an existing technique can be used. For example, a material obtained by subjecting an epoxy-based resin and a resin ball to nickel plating, or the like, can be used. In the embodiment, the individual terminal portions 46 and the common terminal portions 47 and the wiring layers 51 of the wiring substrate 50 are mechanically and electrically connected to each other through an adhesion layer 55 formed by an anisotropic conductive adhesive. It is to be noted that the adhesion layer 55 is provided across the plurality of individual terminal portions 46 arranged in parallel and the common terminal portions 47.

The individual terminal portions 46 and the common terminal portions 47 are electrically connected to the wiring layers 51 each other through the adhesion layer 55 provided between the individual terminal portions 46 and the common terminal portions 47 and the wiring layers 51. In addition, the flow path formation substrate 22 and the wiring substrate 50 are mechanically connected to each other by the adhesion layer 55 provided between the adjacent individual terminal portions 46 or between the individual terminal portions 46 and the common terminal portions 47.

In the ink jet recording head 10 having the above configuration, ink is introduced from an ink cartridge (storage unit) into the manifolds 32 through the ink inlet ports 38 and liquid flow paths from the manifolds 32 to the nozzle openings 34 are filled with ink. Thereafter, a recording signal from a driving circuit (not illustrated) is supplied to the piezoelectric actuators 40 through the wiring substrate 50 so as to flexurally deform the piezoelectric actuators 40 and the vibration plate 23 by applying voltages to the piezoelectric actuators 40 corresponding to the pressure generation chambers 21. With this, pressures in the pressure generation chambers 21 are made higher so that ink droplets are ejected through the nozzle openings 34.

Other Embodiments

An embodiment of the invention has been described above. However, a basic configuration of the invention is not limited to the above configuration.

Figure 5:
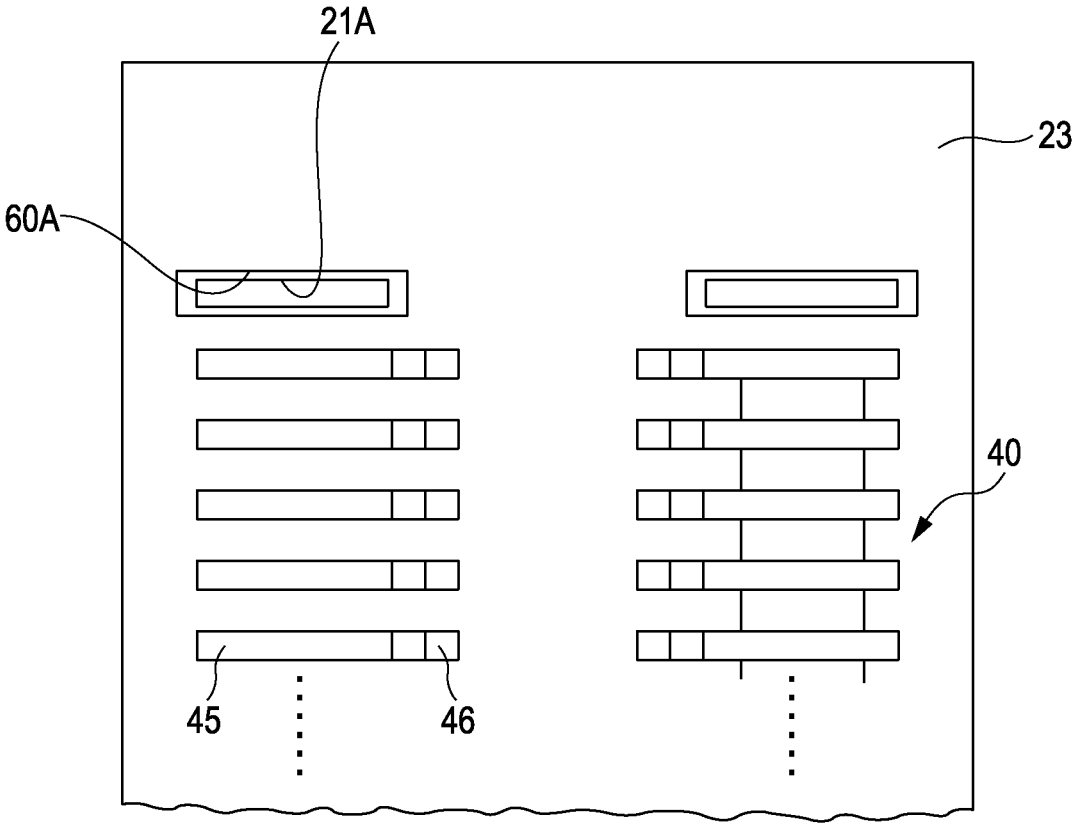
FIG. 5 is a top view illustrating an actuator unit according to another embodiment.

For example, in the above first embodiment, on the vibration plate 23, the two exposure portions 60 which open both ends of each dummy flow path 21A in the second direction are independently provided for one dummy flow path 21A. However, the invention is not particularly limited thereto. Another example of the exposure portions 60 is illustrated in FIG. 5. FIG. 5 is a top view of an actuator unit illustrating another example of the exposure portions according to another embodiment.

As illustrated in FIG. 5, exposure portions 60A are provided to have such a size that the exposure portions 60A expose entire wall surfaces of the dummy flow paths 21A at the side of the vibration plate 23. With this, dimensions of the dummy flow paths 21A in the first direction and the second direction can be measured easily. It is to be noted that when the exposure portions 60A expose the entire dummy flow path 21A, the lower electrode films 43 may be formed across inner surfaces of the dummy flow paths 21A or may be formed on regions opposed to circumferential walls of the dummy flow paths 21A.

Figure 6:
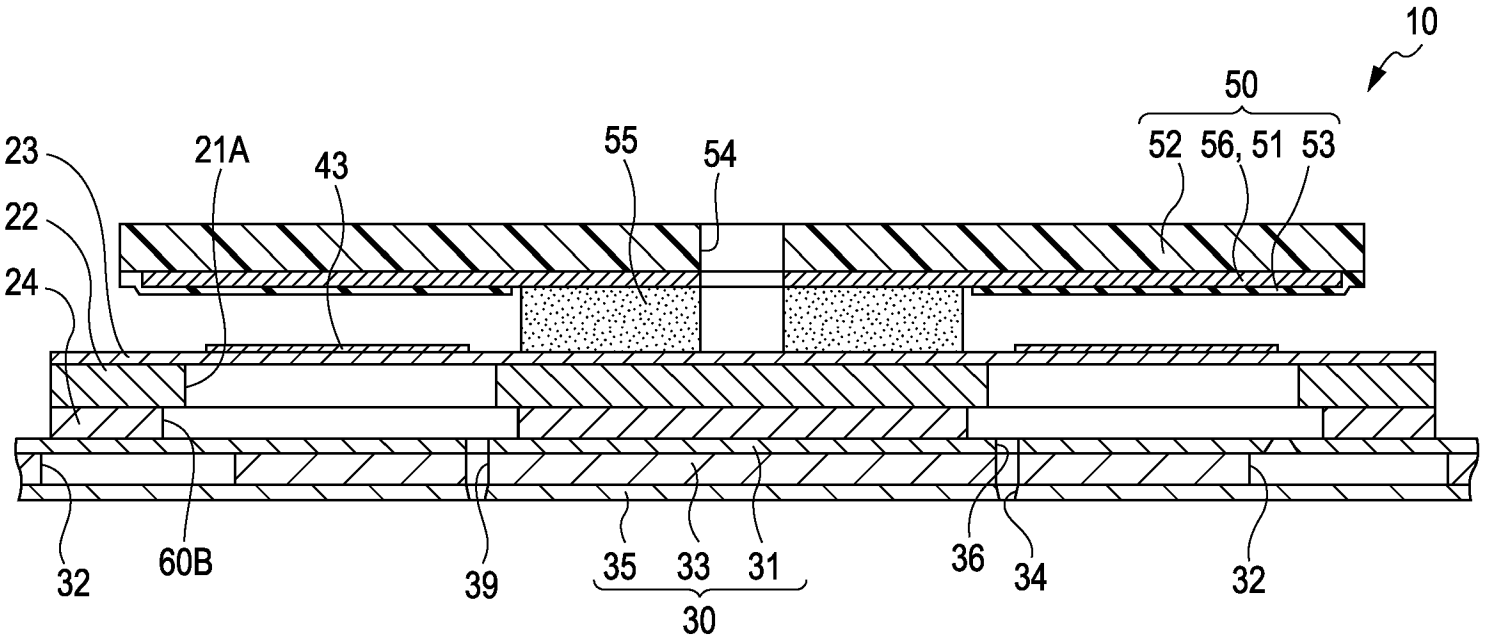
FIG. 6 is a cross-sectional view illustrating a recording head according to another embodiment.

In addition, in the above example, the exposure portions 60, 60A are provided on the vibration plate 23. However, the invention is not particularly limited thereto. It is sufficient that exposure portions are provided on at least one of the vibration plate 23 and the pressure generation chamber bottom plate 24. Then, an example where exposure portions are provided on the pressure generation chamber bottom plate 24 is illustrated in FIG. 6. FIG. 6 is a cross-sectional view of an ink jet recording head illustrating another example of the exposure portion according to another embodiment.

As illustrated in FIG. 6, exposure portions 60B are provided on the pressure generation chamber bottom plate 24 on regions opposed to the dummy flow paths 21A. The exposure portions 60B have opening areas which are larger than openings of the dummy flow paths 21A at the side of the pressure generation chamber bottom plate 24. Further, the ink supply ports 37 are not provided on the ink supply port formation substrate 31 and the dummy flow paths 21A are independently provided so as not to communicate with the manifolds 32. Even when the exposure portions 60B are provided on the pressure generation chamber bottom plate 24 in the above manner, after the flow path formation substrate 22, the vibration plate 23, and the pressure generation chamber bottom plate 24 have been calcined and integrated with one another, dimensions of the dummy flow paths 21A can be measured. It is needless to say that exposure portions which are equivalent to the two exposure portions 60 which expose only both ends of each dummy flow path 21A in the second direction may be provided on the pressure generation chamber bottom plate 24 as in the above first embodiment. Further, the exposure portions 60, 60A, 60B, or the like may be provided on both of the vibration plate 23 and the pressure generation chamber bottom plate 24. It is to be noted that when the exposure portions 60B are provided on the pressure generation chamber bottom plate 24, the piezoelectric actuators 40 may be provided on the vibration plate 23.

Further, in the above first embodiment, the pressure generation chamber bottom plate 24 is provided as the second member provided at the other surface side of the flow path formation substrate 22. However, the second member is not limited to the pressure generation chamber bottom plate 24. For example, the nozzle plate 35 on which the nozzle openings 34 are provided may be provided as the second member instead of the pressure generation chamber bottom plate 24. When the second member is the nozzle plate 35 in this manner, it is preferable that the exposure portions 60, 60A be provided on the vibration plate 23 and be provided at positions opposed to the nozzle openings 34. With this, opening shapes and opening dimensions of the nozzle openings 34 at the side of the pressure generation chambers 21 can be checked after calcination so as to improve manufacturing yield. Note that the nozzle openings 34 have such tapered shapes that opening areas of the nozzle openings 34 are increased toward the side of the pressure generation chambers 21. Therefore, if the exposure portions are not provided, the opening shapes after calcination, in particular, the opening shapes at the side of the pressure generation chambers 21 cannot be checked.

In the above first embodiment, the thick film-type piezoelectric elements 40 are used as a pressure generation unit. However, the pressure generation unit is not particularly limited thereto. For example, a thin film-type piezoelectric actuator in which a lower electrode, a piezoelectric layer, and an upper electrode are film-formed and are laminated in this order by a lithography method, a longitudinal vibration-type piezoelectric actuator in which piezoelectric materials and electrode formation materials are alternately laminated so as to extend and contract them in an axial direction, or the like, can be used as the pressure generation unit.

Figure 7:
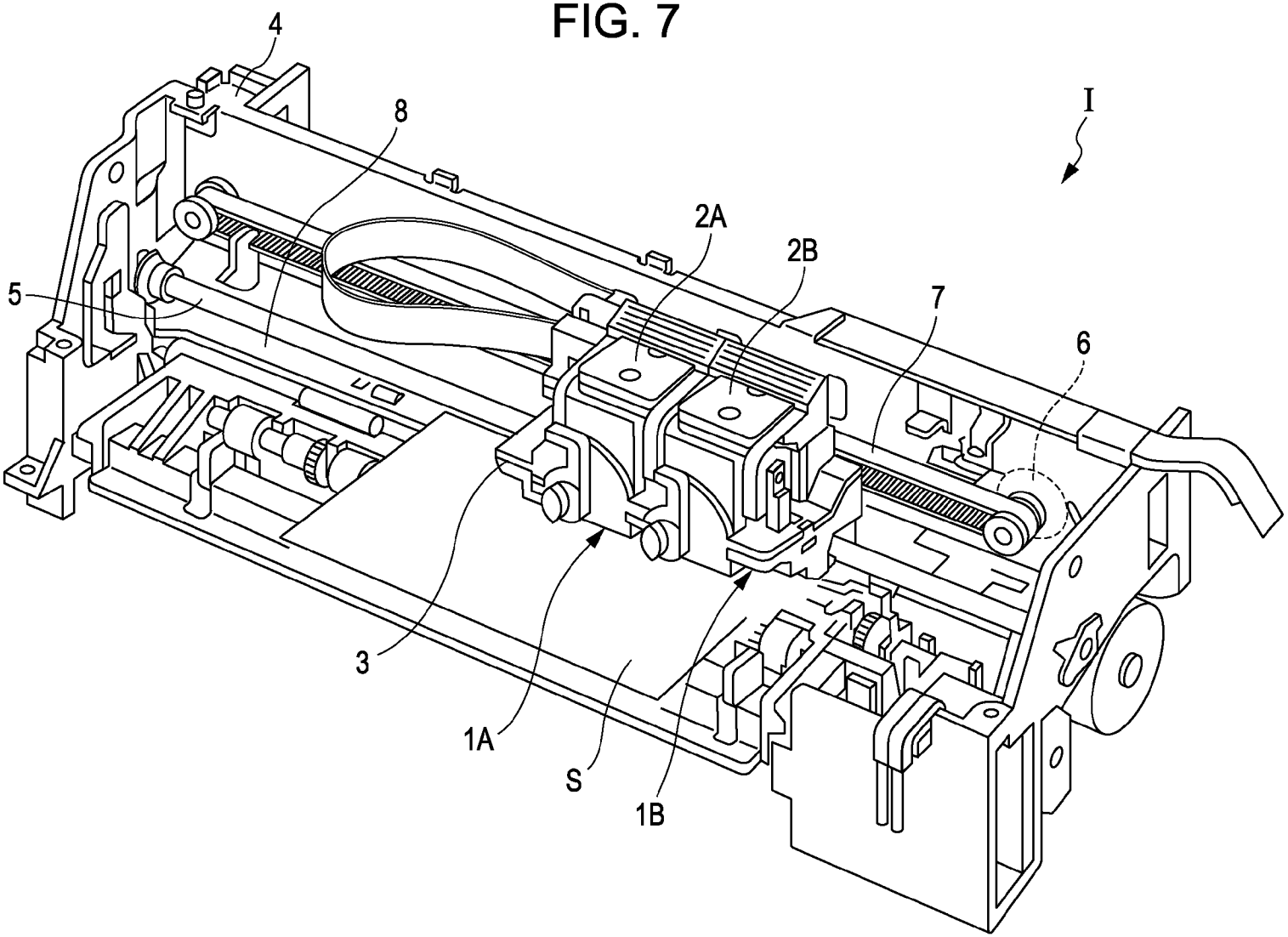
FIG. 7 is a schematic view illustrating an ink jet recording apparatus according to one embodiment of the invention.

The ink jet recording head according to the above embodiments constitutes a part of a recording head unit including an ink flow path communicating with an ink cartridge and the like and is mounted on an ink jet recording apparatus. FIG. 7 is a schematic view illustrating an example of the ink jet recording apparatus.

As illustrated in FIG. 7, cartridges 2A, 2B constituting an ink supply unit are provided on recording head units 1A, 1B each having the ink jet recording head 10 in a detachable manner. A carriage 3 on which the recording head units 1A, 1B are mounted is provided on a carriage shaft 5 attached to a main apparatus unit 4 in a movable manner in the shaft direction. The recording head units 1A, 1B discharge black ink composition and color ink composition, respectively, for example.

Then, a driving force of a driving motor 6 is transmitted to the carriage 3 through a plurality of gears (not illustrated) and a timing belt 7. With this, the carriage 3 on which the recording head units 1A, 1B are mounted is moved along the carriage shaft 5. On the other hand, a platen 8 is provided on the main apparatus unit 4 along the carriage shaft 5 and a recording sheet S as a recording medium, such as paper, which has been fed by a paper feeding roller (not illustrated) and the like, is wound around the platen 8 so as to be transported.

The above ink jet recording apparatus I in which the ink jet recording heads 10 (head units 1A, 1B) are mounted on the carriage 3 and move in the main scanning direction has been described as an example. However, the invention is not particularly limited thereto and can be applied to a so-called line-type recording apparatus in which the ink jet recording head 10 is fixed and printing is performed only by transporting a recording sheet S such as paper in the sub scanning direction, for example.

Further, in the above first embodiment, the ink jet recording head 10 as an example of a liquid ejecting head and the ink jet recording apparatus I as an example of a liquid ejecting apparatus have been described. However, the invention can be also widely applied to liquid ejecting heads and liquid ejecting apparatuses which are generally used. It is needless to say that the invention can be also applied to liquid ejecting heads and liquid ejecting apparatuses which eject liquid other than ink. Other liquid ejecting heads include various recording heads used in image recording apparatuses such as a printer, a color material ejecting head used for manufacturing a color filter such as a liquid crystal display, an electrode material ejecting head used for forming an electrode such as an organic electroluminescence (EL) display and a field emission display (FED), and a bioorganic material ejecting head used for manufacturing a biochip. Further, the invention can be also applied to liquid ejecting apparatuses including the above liquid ejecting heads.

The entire disclosure of Japanese Patent Application No. 2011-116641, filed May 25, 2011 is incorporated by reference herein.

What is claimed is:

1. A liquid ejecting head comprising:

a flow path formation substrate on which an individual flow path communicating with a nozzle opening for ejecting liquid is provided;

a first member that is provided at one surface side of the flow path formation substrate and has a pressure generation unit which generates pressure change in liquid in the individual flow path; and a second member that is provided at another surface side of the flow path formation substrate, which is opposite to the first member, wherein the liquid ejecting head is a liquid ejecting head formed by a calcined member in which the flow path formation substrate, the first member and the second member are integrated with one another, a dummy flow path is provided on the flow path formation substrate independently of the individual flow path, and an exposure portion that directly exposes a part of wall surfaces of the flow path formation substrate, which form the dummy flow path, so that the part of the wall surfaces is viewable through the exposure portion from outside the first member or the second member and forms an exposed portion, the exposure portion is provided on at least one of the first member and the second member.

2. The liquid ejecting head according to claim 1, wherein the exposure portion exposes two opposed surfaces among the wall surfaces of the flow path formation substrate which form the dummy flow path.

3. The liquid ejecting head according to claim 1, wherein the exposure portions are provided at at least both ends in a second direction intersecting with a first direction which is a direction in which the dummy flow path and the individual flow path are arranged in parallel.

4. The liquid ejecting head according to claim 1, wherein the exposure portion is provided path at a side of the second member so as to be opposed to an opening of the nozzle opening communicating with the dummy flow.

5. The liquid ejecting head according to claim 1, wherein the dummy flow path is provided so as to penetrate through the flow path formation substrate.

6. A liquid ejecting apparatus comprising the liquid ejecting head according to claim 1.

7. A liquid ejecting apparatus comprising the liquid ejecting head according to claim 2.

8. A liquid ejecting apparatus comprising the liquid ejecting head according to claim 3.

9. A liquid ejecting apparatus comprising the liquid ejecting head according to claim 4.

10. A liquid ejecting apparatus comprising the liquid ejecting head according to claim 5.

* * * * *